US005373871A

United States Patent [19]

Speich

[11] Patent Number: 5,373,871

[45] Date of Patent: Dec. 20, 1994

[54] ELECTROMAGNETIC SHEDDING DEVICE FOR A TEXTILE MACHINE

[75] Inventor: Francisco Speich, Gipf-Oberfrick, Switzerland

[73] Assignee: Textilma AG, Hergiswil, Switzerland

[21] Appl. No.: 946,311

[22] PCT Filed: Mar. 2, 1992

[86] PCT No.: PCT/CH92/00041

§ 371 Date: Nov. 5, 1992

§ 102(e) Date: Nov. 5, 1992

[87] PCT Pub. No.: WO92/16678

PCT Pub. Date: Oct. 1, 1992

[30] Foreign Application Priority Data

Mar. 13, 1991 [CH] Switzerland ..... 730/91

[51] Int. Cl.[5] ..... D03C 3/20; D03C 3/06

[52] U.S. Cl. ..... 139/455; 139/59; 139/65

[58] Field of Search ..... 139/455, 59, 65

[56] References Cited

U.S. PATENT DOCUMENTS

| | | | |
|---|---|---|---|
| 4,593,723 | 6/1986 | Griffith . | |
| 4,936,357 | 6/1990 | Keim et al. . | |
| 4,969,490 | 11/1990 | Seiler . | |
| 5,002,099 | 3/1991 | Seiler | 139/455 |
| 5,095,952 | 3/1992 | Cheng | 139/455 |
| 5,309,952 | 5/1994 | Speich | 139/455 |

FOREIGN PATENT DOCUMENTS

| | | |
|---|---|---|
| 0119787 | 9/1984 | European Pat. Off. . |
| 0348338 | 3/1989 | European Pat. Off. . |
| 3713832 | 6/1988 | Germany . |

OTHER PUBLICATIONS

International Search Report dated Jun. 22, 1992.

*Primary Examiner*—Andrew M. Falik

*Attorney, Agent, or Firm*—Diller, Ramik & Wight

[57] ABSTRACT

A shedding device for a textile machine contains two lifting blades (120) which move to and fro antagonistically, two traction elements (121) which can be engaged and disengaged with the lifting blades (120) and an insertion device (12) which is arranged so that the traction elements adopt a defined position with respect to the pole regions when in the lower shed position. The traction elements (121) have coupling parts (123) with hooks (126) which can be coupled with matching lifting blade parts, and stop parts (54) which co-operate with the stop board (46) for the rest position and with the lower edge of the lifting blade (120) so that they move to and fro interlocked with the traction elements (121) coupled with the blades (120). As a result of this defined position and of the insertion and withdrawal of the traction elements from the lower shed position and the interlocking drive, the power of the electromagnets and of the shedding machine can generally be markedly reduced with a reliable switching function at high frequency up to 2500 $min^{-1}$.

34 Claims, 5 Drawing Sheets

ELECTROMAGNETIC SHEDDING DEVICE FOR A TEXTILE MACHINE

BACKGROUND OF THE INVENTION

The present invention relates to a novel shedding device.

A device of this kind is known from the EP-A 348 338. In a device of this type a hooking device is formed at the so-called hooking-in element which can engage and disengage a counterhook which is formed at the lifting blade. The hooking-in element is brought into the hook-in position by means of the slickenside draw. This requires a high restoring force of the slickenside for requisite high speed operation. The pivoting of the hooking-in element is counteracted by the friction caused by the restoring force of the slickenside between a supporting ledge and a supporting heel. Furthermore, the pulling force acting from the slickenside on the hooking-in element is smallest when the hooking-in element is located in the lower shed position. Therefore, the restoring force of the slickenside must be considerably high.

SUMMARY OF THE INVENTION

An object of the invention is to provide a shedding device in which the pulling elements are guided by the lifting blades during the upward movement and downward movement and are designed of extreme low mass.

The advantages gained by the invention can be seen substantially in that

- the oscillations of the pulling members produced by the retention procedure are low,
- the falling off of pulling elements during the upward and downward movement is prevented and accordingly,
- a rotation of 2500 $min^{-1}$ is provided,
- a considerable reduction of noise results
- a considerable reduction of the restoring pulling force of the slickenside is achieved and
- a large reduction of the wear of pulling elements, retention device, blocks and tackles, cords and slickensides is gained.

The invention will be explained with reference to the appended drawings.

DESCRIPTION OF THE PREFERRED EMBODIMENTS

Figure 1:
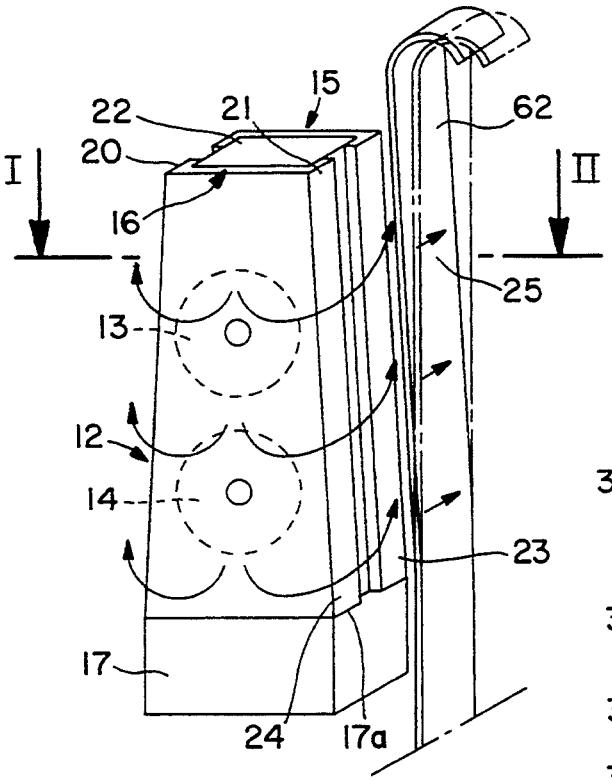
FIG. 1 is a spatial view of a first embodiment of an inventive magnetic retention device.

A shedding device of the present invention includes a kinematic connecting member 1, which interconnects pulling elements in the form of , a block and tackle 2 having a first disk 3, around which the connecting member 1 is guided, and a second disk 4, which is connected to the first disk 3 by web parts 5, a cord 6, which is guided around the second disk 4 and is connected to the weaving heddle 7 for the guiding of warp threads, and a restoring spring 8, which is mounted to the end of the weaving heddle 7. The other end of the cord 6 is connected to the machine frame.

The shedding device includes, furthermore, two lifting blades, which are oppositely movable upwards and downwards, two pulling elements, which are movable upwards and downwards between a lower shed and an upper shed position and an electrically controllable magnetic retention device with a control device.

The lifting blades, pulling elements and the retention device will be described in detail based on the appended drawings for the inventive embodiments of the shedding devices.

Figure 2:
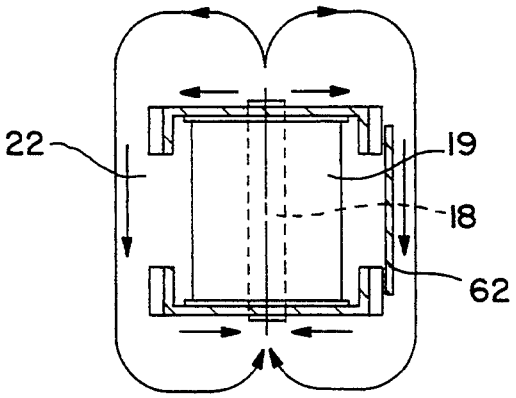
FIG. 2 is a section along the line II—II in FIG. 1.

In the FIGS. 1 and 2 a first embodiment of a retention device 12 is shown. The retention device 12 includes two electromagnets 13, 14 (FIG. 1) and two pole plates 15, 16 and a support 17. Every electromagnet consists of a cylindrical core 18 and a winding 19, which is wound on the core (FIG. 2).

Each pole plate 15, 16 has a U-shaped cross section, which converges over the length of the pole plate, such that the legs 20, 21 form inclined surfaces. The pole plates 15, 16 are arranged in such a manner, that the ends of the legs are located oppositely of each other at a distance. The electromagnets 13, 14 are located between the pole plates 15, 16. The electromagnets 13, 14 and the pole plates 15, 16 are connected by a plastic material mass 22, which fills the hollow spaces between the pole plates and the slot between the ends of the legs. Accordingly, a wedge shaped unit with two inclined surfaces is formed.

A portion of a pulling element 62 is attracted when the electromagnets 13, 14 are energized, such as illustrated in FIG. 1, such that this portion abuts the inclined surfaces, which are formed by the outer side of the pole plate legs 20, 21. In this case the pole plate legs 20, 21 form pole areas 23 and 24, such that the lines of force 25 of the electromagnets are oriented in a direction lateral to the pulling element 62. A base edge 17*a* is formed by the lower broad portion of the retention device 12.

Figure 3:
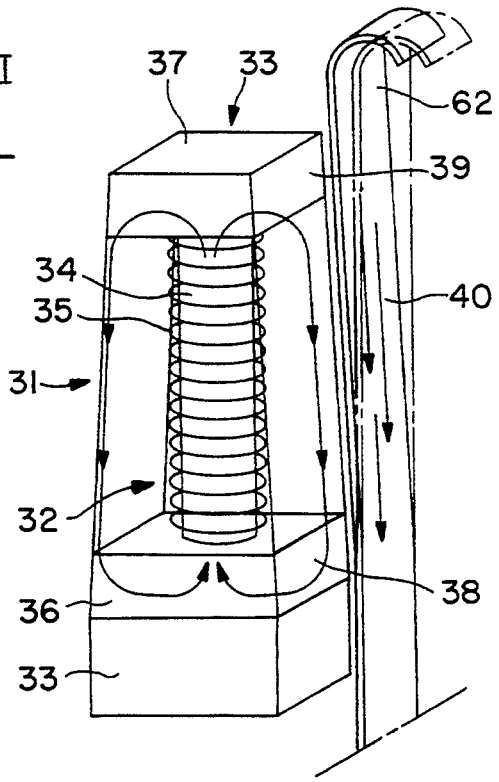
FIG. 3 is a spatial view of a second embodiment of an inventive retention device.

FIG. 3 illustrates a second embodiment of retention device. This retention device 31 has an electromagnet 32 and a support 33 for the electromagnet. The electromagnet 32 consists of a double-T-shaped core 34 and a winding 35. The core 34 has a web portion, on which the winding is arranged in an insulated manner and a broad base flange 36 and a narrow flange 37, which comprise at the sides facing the pulling elements 62 inclined surfaces, which form defines pole areas 38 and 39.

Such as indicated in FIG. 3, a portion of the pulling element 62 is attracted when the electromagnet 32 is excited, such that this portion lies on the inclined surfaces of the flanges 36, 37 of the core 34, whereby the lines of force 40 are oriented in the longitudinal direction of the pulling element 62. By means of such the magnetic circuit is short-circuited, such that the power consumption of the electromagnet 32 is reduced in an advantageous way.

FIGS. 4 to 7 illustrate a first embodiment of an inventive shedding device. The shedding device includes two lifting blades 41, which are moved oppositely upwards and downwards by a not illustrated driving device, two pulling elements 42, which can be brought to engage or disengage the lifting blades 41 and the retention device 12 illustrated in FIG. 1 with the not in detail illustrated electrical circuit 43, which are arranged in the area of the lower shed position between the pulling elements 42. The retention device 12 is mounted with the support 17 on a fixed mounting board 44. Openings 45 are foreseen in the mounting board, in which the pulling elements 42 are guided.

Figure 7:
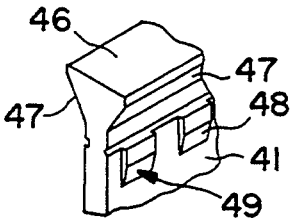
FIG. 7 is an enlarged fragmentary prospective view of an upper end portion of one of the lifting blades, and illustrates projection each cooperative with an associated port or opening of an associated pulling element.

The lifting blades 41 have a rectangular cross section and include at the upper edge a section 46 having two inclined surfaces 47, which section extends along the length of the lifting blade and includes hook-shaped designed portions 48 which are at a distance from the portion 46 and project from the sides of the lifting blades 41, wherewith a ramping surface 49 is formed (FIG. 7).

Figure 5:
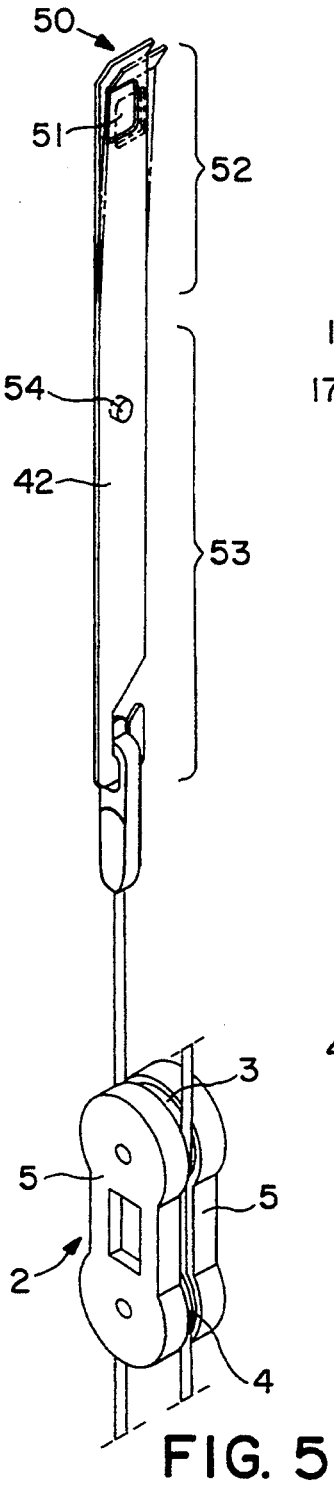
FIG. 5 is an enlarged fragmentary perspective view of one of the pulling elements, and illustrates an upper coupling portion, a lower guiding portion, and cooperative means in the form of a projection or abutment which is associated with its lifting blade.

The pulling elements 42 are of a strip-like design. At a lower end the pulling elements 42 are connected to the connecting member 1 by means of a hook-in element. At an upper end the pulling elements 42 comprise an inclined section 50 and adjacent thereof a square port or opening 51 (FIG. 5). The portion of the pulling elements 42 comprising each inclined section 50 and the port or opening 51 forms a coupling portion 52 and the portion adjacent thereof a guiding portion 53. Each pulling element 42 has, furthermore, a stop member 54, which is mounted to the guide portion 53 and projects outwards therefrom and which lies onto the abutment board 44 when the pulling element 42 is in the lower shed position.

The pulling elements 42 consist of a magnetizable material, preferably of metal. It is, however, also possible to produce the pulling elements 42 of a plastic material, whereby, however, at least the coupling portion 52 must be provided with metal additions.

Figure 6:
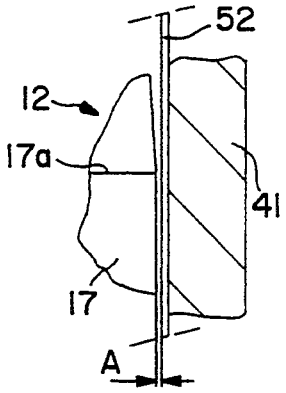
FIG. 6 is an enlarged fragmentary cross-sectional view of one of the pulling elements in its lower shed position and the associated electromagnet de-energized.

In FIG. 6 the state is illustrated on an enlarged scale, in which the pulling element 42 is in the lower shed position and the electromagnets 13, 14 of the retention device 12 are not excited. In this position the coupling portion 52 of the pulling element 42 is in a defined position relative to the pole areas 23, 24 of the retention device 12. In this position a distance A of a magnitude almost zero is present between the base edge 17*a* of the pull areas 23, 24 and the coupling portion 52 of the pulling element 42, which, however, is illustrated in FIG. 6 due to illustrative reasons larger. By means of this it is arrived at that on the one hand the coupling portion 52 is deflected upon an excitation of the electromagnets 13, 14 only over a very short distance and, on the other hand, that its remanence can be held small.

Now, the operation of the shedding device according to FIGS. 4 through 7 will be described.

Figure 4:
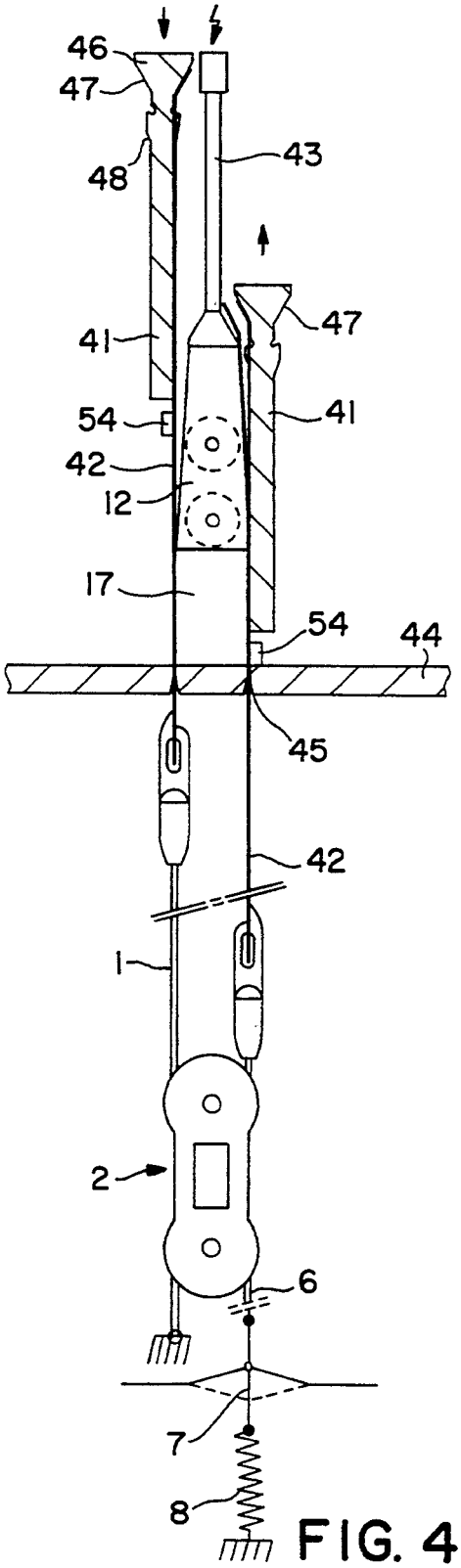
FIG. 4 is a fragmentary simplified schematic view of a shedding device, and illustrates two lifting blades, each having associated therewith one of a pair of pulling elements and the retention device of FIG. 1.

In FIG. 4 the left lifting blade 41 is in the upper shed position, in which it is positioned substantially above the retention device 12 and the right lifting blade 41 is illustrated in the lower shed position, in which it is located adjacent the retention device 12. It can be seen in FIG. 4 that the left pulling element 42 with its port or opening 51 is hooked into the hooked shaped portion 48 and is, therefore, located by the lifting left blade 41 in the upper shed position. On the other hand, the right pulling element 42 is in the lower shed position with the stop portion 54 thereof abutting the abutment board 44 and the coupling portion 52 drawn against the retention device 12 because the electromagnet is energized. In this position the heddle 7 is in the upper shed. If the lifting blades 41 are oppositely moved by the drive, the left pulling element 42 is moved downward by the left lifting blade 41 into the lower shed position by the cooperative mutual abutment of a lower abutment face (unnumbered) of the lifting blade 41 which engages an upper abutment face (unnumbered) of the stop member 54 creating a vertical pushing force, whereas the right pulling element 42 remains in the lower shed position, because the coupling portion 52 which is deflected by the excited electromagnets 13, 14 has not been engaged by the right lifting blade 41. Thus, the pulling elements 42 and the lifting blades 41 are movable along predetermined substantially parallel linear paths of movement which are generally up and down or vertically as viewed in FIG. 4. In this position the warp thread 7 is located in its lower shed. During the downwards movement of the left lifting blade 41 the pulling element 42 hooked therein is moved positively, i.e., in a locked manner, downwards with the aid of the portions 47, 50 and is placed with the stop member 54 against the abutment board 44, whereby the lifting blade 41 continues its downwards movement until its engagement with the stop member 54. Therefore, the lower edge of the port 51 rides over the ramping surface 49, such that the coupling portion 52 is lifted out of the hook shaped portion 48, i.e. the left pulling element 42 is uncoupled. At the same time the coupling portion 52 is pivoted therewith in the direction of the retention device 12 and pressed against the pole areas 23, 24 of the retention device 12 (FIG. 1). This pressing-on procedure is guaranteed by the section 56 at the lifting blade 41, because the section 50 at the pulling element 42 glides on the inclined surface 47, such that the coupling portion 52 is pivoted in the direction of the retention device 12.

If the electromagnets 13, 14 of the retention device 12 are excited at this time, the coupling portion 52 remains adhering to the retention device 12. At the following upwards movement of the left lifting blade 41 the left pulling element 42 is left back, i.e. the heddle 7 remains in the lower shed position. If due to a pattern program the electromagnets 13, 14 are disenergized, the coupling portions 52 will lift off the retention device 12 due to their own elastic force. In this position the pulling elements 42 are engaged subsequently by the lifting blades 41 and moved upwards and downwards. A change happens then, when the electromagnets 13, 14 are again excited.

Figure 8:
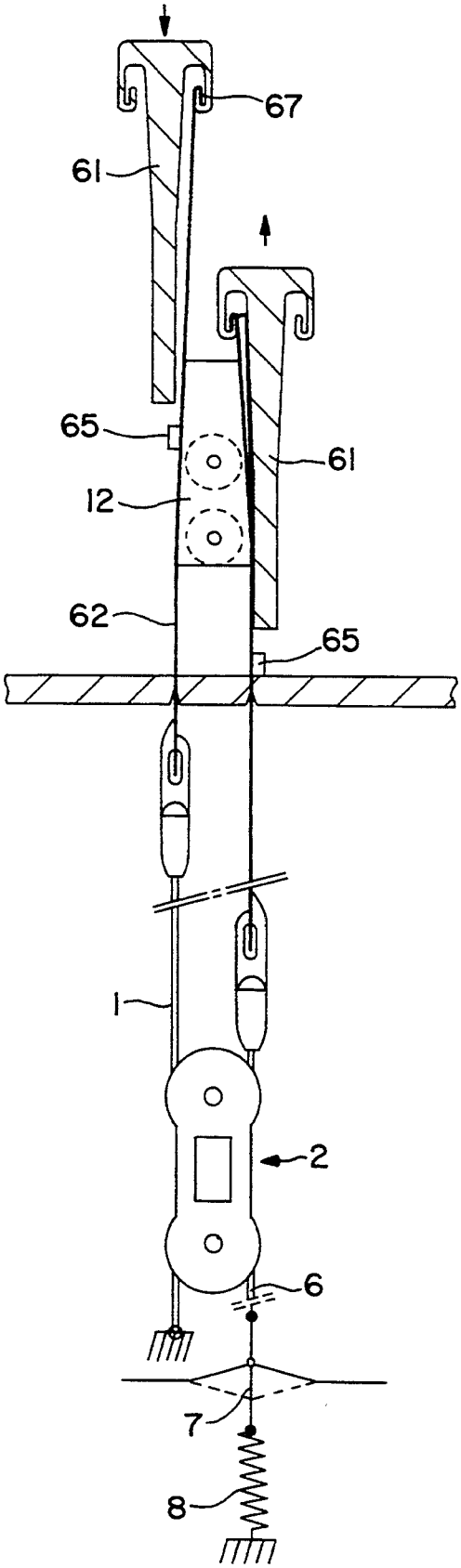
FIG. 8 illustrates another shedding device of the present invention and illustrates two lifting blades and associated pulling elements having respective upwardly opening and downwardly opening cooperative hooks or hooking portions.
Figure 9:
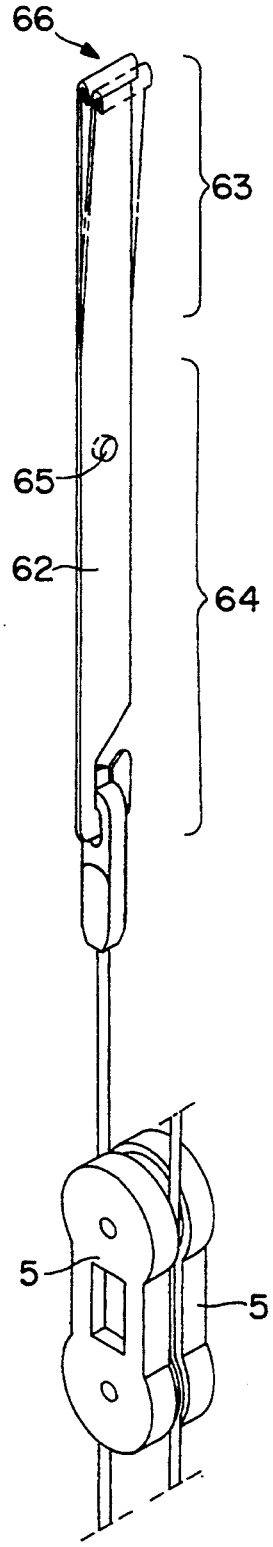
FIG. 9 is a perspective view of one of the pulling elements of FIG. 8, and illustrates the specific configuration thereof.
Figure 10:
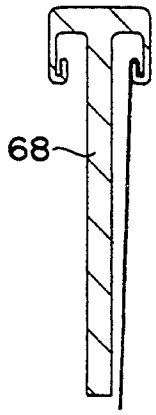
FIG. 10 is an enlarged cross-sectional view of one of the lifting blades and pulling elements of FIG. 8, and illustrates the same with the hooks or hook portions in engaged relationship.

FIGS. 8 to 10 illustrate a second embodiment of the inventive shedding device with another construction of the lifting blades and of the pulling element.

The shedding device comprises two lifting blades 61 and two pulling elements 62 with a coupling portion 63 and a guide portion 64. Such as illustrated in FIG. 8, the lifting blade has a cross-sectional shape with a square lower portion, a center portion diverging upwards and a substantially U-shaped upper portion. Whereas the lower portion causes the adjusting of the pulling element 62 in the defined position relative to the pull areas 23, 24 (FIG. 6), the center portion causes during the downwards movement of the lifting blade 61 the pivoting of the coupling portion 63 in the directed of the retention device 12 in order to place the coupling portion 63 onto the pole areas 23, 24 (FIG. 1). Each pulling element 62 has a stop member 65.

The pulling element 62 includes at its coupling portion 63 a hook-shaped section 66. Two hooked shaped sections 67 are foreseen at the upper part of the lifting blade 61, which are arranged complementary to the section 66 at the pulling element 62, such that the lifting blades 61 can be brought to engage and disengage the pulling elements.

In FIG. 10 another lifting blade 68 is illustrated, of which the cross-sectional shape includes a square portion and a substantially U-shaped upper portion. Contrary to the lifting blade 61 no pivoting of the coupling portion 63 occurs during the downwards movement of the lifting blade 68.

Figure 11:
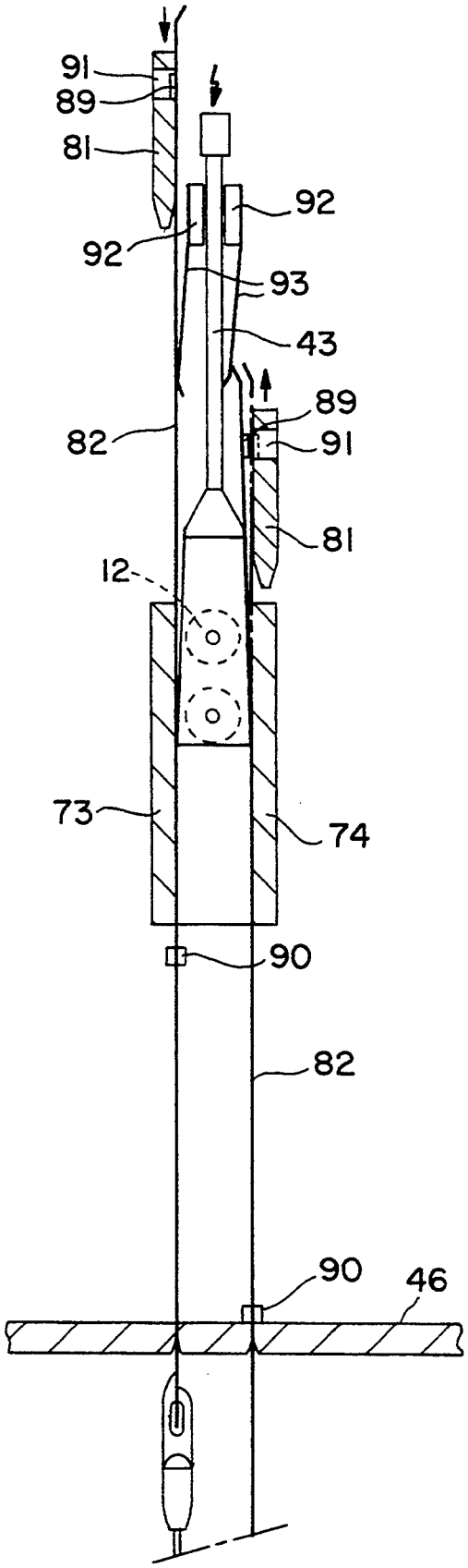
FIG. 11 is another fragmentary sectional view of another shedding device of the present invention, and illustrates a pair of projections associated with each of a pair of pulling elements which are in turn cooperative with a pair of lifting blades.
Figure 12:
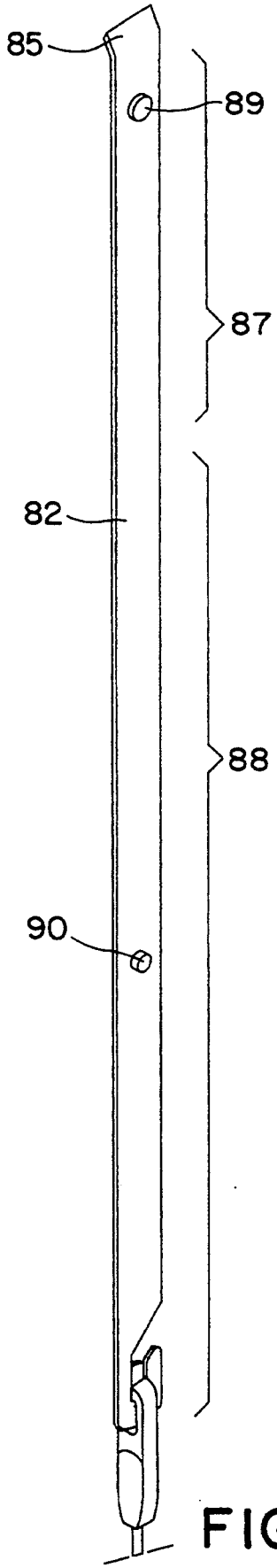
FIG. 12 is an enlarged perspective view of one of the pulling elements of the shedding device of FIG. 11, and more clearly illustrates the details thereof.
Figure 14:
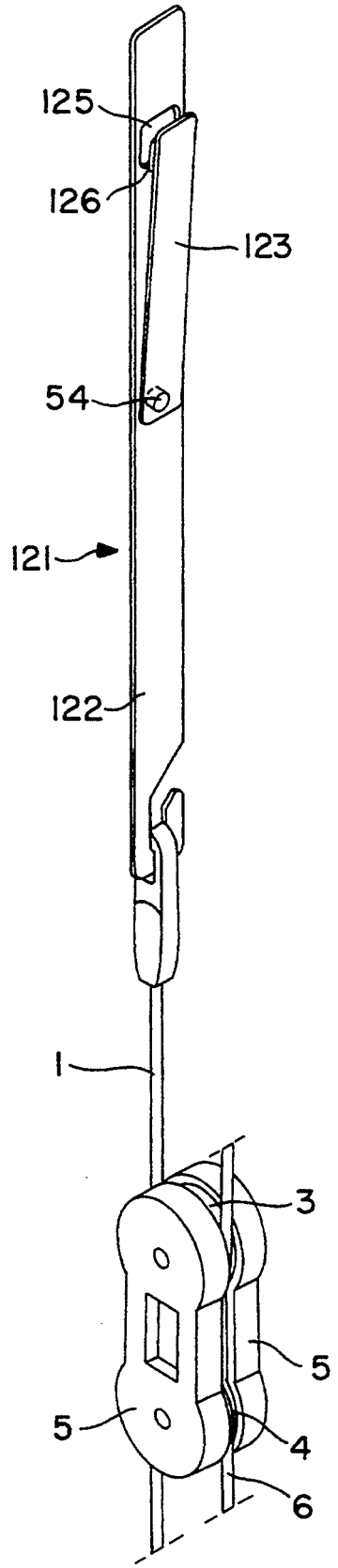
FIG. 14 is a perspective view of one of the pulling elements of the shedding device of FIG. 13, and illustrates one of the projections carried by a flexible strip with this projection being aligned with an opening or port of the pulling element.

As shown in FIG. 14, the lifting blade 17 is designed roughly in the same manner as the lifting FIGS. 11 and 12 illustrates a third embodiment of another inventive shedding device.

The shedding device includes two lifting blades 81, two pulling elements 82, an retention device 12 illustrated in FIG. 1 and said two guide members 73, 74, between which the insertion device 12 is located in such a manner, that in the lower shed position the pulling elements 82 attain a defined position relative to the pole areas, 23, 24 (FIG. 1).

The pulling element 82 is of a strip-shaped design. At a lower end the pulling element 82 is connected via a hooking-in element to the kinematic connecting member 1. An inclined section 85 is an upper end. The pulling element is divided into a coupling portion 87 and a guide portion 88. A projecting stop part 89 is mounted on one side of the coupling portion 87 and at both sides thereof stop parts 90 project which are wound on the guide portion 88 and which abut the abutment board 46 when the pulling element 82 is in the lower shed position.

The lifting blade 81 has a substantially square cross-sectional shape with a converging section at the lower portion. This portion can be done away with. Holes 91 are foreseen in the lifting blades 81, in which the stop part 89 of the pulling element 82 can engage to, such that the pulling element can be moved upwards and downwards by the corresponding lifting blade. The electric circuit 43 mounted to the retention device 12 is foreseen at the same time as support for two resetting devices 92. The resetting device includes a leaf spring 93, which is in contact with a respective pulling element and exerts on the coupling portion 87 a force counteracting the attracting force of the retention device, when the pulling element 82 is in the lower shed position. By means of this the coupling portion 87 of the pulling element is lifted off the pole areas 23, 24 of the retention device 12, when the electromagnets 13, 14 are not excited (FIGS. 1, 2).

Figure 13:
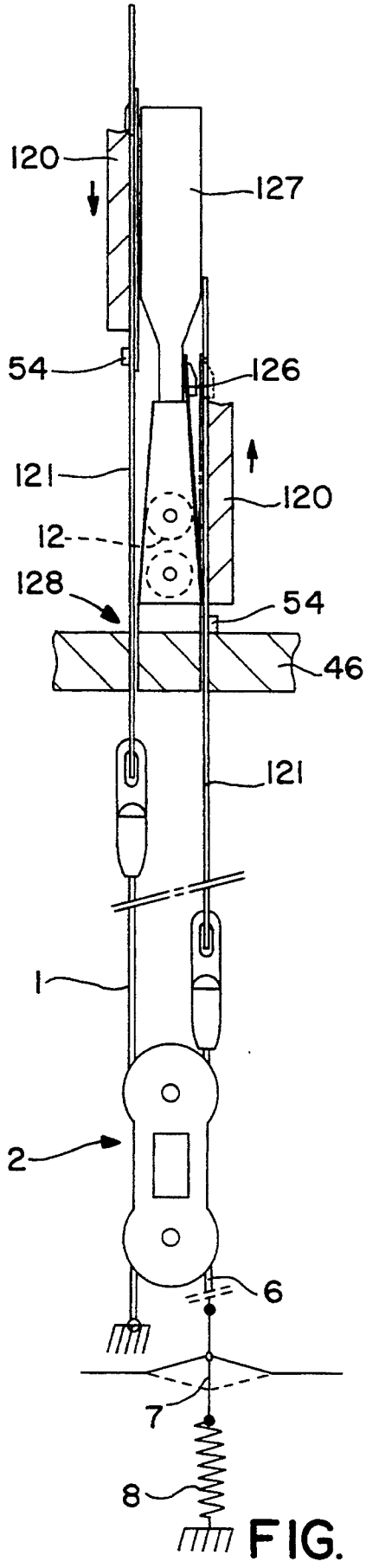
FIG. 13 is another fragmentary diagrammatic view of a shedding device of this invention, and illustrates two lifting blades and two pulling elements with each pulling element having a pair of projections.

FIGS. 13 and 19 illustrate a fourth embodiment of an inventive shedding device.

The shedding device includes two lifting blades 120, two pulling elements 121 and an retention device 12 illustrated in FIG. 1, which is arranged in such a manner, that it is located between the pulling elements 121, when latter are in the lower shed position. In this lower shed position the pulling elements attain a defined location relative to the pole areas 23, 24 (FIG. 1).

The pulling element 121 includes a strip shaped guide portion 122 and a strip shaped coupling portion 123, which is mounted the guide portion 122. The guide portion 122 is mounted at one end to the kinematic connecting member 1. At the area of the other end a square opening 125 is foreseen. The guiding portion 122 consists advantageously of a material, which is not magnetizable. Each pulling element 121 has a stop portion 54, which is mounted outside projecting to the lifting blade 120 at the guide portion 122 and which lies against the abutment board 46, when the pulling element 121 is in the lower shed position, or causes the lifting blade 120 to positively move the pulling element 121 into the lower shed position.

The coupling portion 123 has at one end a hook shaped portion 126 which can project through the opening 125. The coupling portion 123 consists of an elastically deformable material, which is magnetizable and is pivotable towards the magnet pole 23, 24. The double part design of this pulling element 121 is specifically advantageous, because no magnetic attraction force is exerted onto the guide portion 122.

A guide member 127 is arranged above the insertion device 12, onto which coupling portions 123 lie, when the pulling element 121 is in the upper shed position. An opening 128 is foreseen in the abutment board 46, in which the guide portion 122 is guided during the upwards and downwards movement. Accordingly, a double guiding for the pulling element 121 is arrived at. The guiding can be improved, when a groove shaped recess is foreseen in the guide member 127, which receives the coupling portion 123 during the upwards and downwards movement of the pulling element, such that the guide portion 122 is guided at the edges of the guide member 127.

Although a preferred embodiment of the invention has been specifically illustrated and described herein, it is to be understood that minor variations may be made in the apparatus without departing from the spirit and scope of the invention, as defined the appended claims.

I claim:

1. A shedding device for a textile machine comprising two oppositely movable lifting blades (41, 41; 61, 61; 68, 68; 81, 81; and 120, 120) each associated with a pair of pulling elements (42, 42; 62, 62; 82, 82; and 121, 121), said lifting blades (41, 41) being reciprocal between a lower shed position and an upper shed position, said pulling elements (42, 42) being interconnected in pairs by kinematic connecting means including a kinematic connecting element (1) entrained about a pulling block (2) and connected to a strand (7), said lifting blades (41, 61) and pulling elements (42, 62) having first cooperative means (51, 48; 66, 67) for engaging each other in cooperation with retention device means (12) having at least one electromagnetic means (13,14) constructed and arranged such that in an area of a lower shed position said electromagnetic means can be energized or de-energized in accordance with a pattern program to selectively engage or disengage said first cooperative means whereby said pulling elements can be moved into the upper shed position or left in the lower shed position, said lifting blades and pulling elements further including second cooperative means (41, 54; 61, 65) for engaging each other to move an associated pulling element and lifting blade into the lower shed position said pulling elements and lifting blades being adapted to be movable along a predetermined substantially linear path of movement, said second cooperative means (41, 54; 61, 65) including mutual abutment faces disposed substantially normal to said predetermined substantially linear path of movement which creates a vertical pushing force of the lifting blades relative to associated pulling elements thereby effecting substantially exclusive linear movement along said predetermined path, each pulling element being in the form of an elongated member having a guiding portion (53, 64), means (45) in the form of a fixed mounting board (44, 46) associated with each pulling element guiding portion for guiding each pulling element during the movement thereof under the control of said retention device means (12), said retention device means (12) being of a wedge-shaped configuration, said at least one electromagnetic means (13,14) defining magnetic areas (23; 24; 38; 39) which are formed in association with cooperative pairs of inclined surfaces with each inclined surface associated with one of said pulling elements, said retention device means (12) each including a base edge, and a predetermined air gap (A) being defined between each base edge and an associated pulling element.

2. The shedding device as defined in claim 1 wherein said at least one electromagnetic means defines a magnetic flux path which acts directly upon each associated pulling element.

3. The shedding device as defined in claim 1 wherein each of said pulling elements is constructed of plastic material.

4. The shedding device as defined in claim 1 wherein each of said pulling elements is constructed of metallic material.

5. The shedding device as defined in claim 1 wherein each of said pulling elements is constructed of resilient plastic material.

6. The shedding device as defined in claim 1 wherein each of said pulling elements is constructed of resilient metallic material.

7. The shedding device as defined in claim 1 wherein the guiding portions of cooperative pairs of pulling elements are connected to said kinematic connecting element, and each pulling element further includes an upper end portion (52, 63, etc.) carrying said first cooperative means.

8. The shedding device as defined in claim 1 wherein each pulling element of a cooperative pair of pulling elements has an upper end portion carrying said first cooperative means, and each pulling element of each cooperative pair of pulling elements includes a medial portion between the associated upper end portion and guiding portion thereof carrying said second cooperative means.

9. The shedding device as defined in claim 8 wherein each of said upper end portions is flexible.

10. The shedding device as defined in claim 8 wherein each of said upper end portions is formed of magnetizable material.

11. The shedding device as defined in claim 8 wherein each of said upper end portions is bendable.

12. The shedding device as defined in claim 8 including resetting means (92) for moving selected upper end portions of said pulling elements away from said insertion device means when said at least one electromagnetic means is de-energized.

13. The shedding device as defined in claim 8 wherein at least one of said first and second cooperative means is a projection.

14. A shedding device for a textile machine comprising two oppositely movable lifting blades (41, 41; 61, 61; 68, 68; 81, 81; and 120, 120) each associated with a pair of pulling elements (42, 42; 62, 62; 82, 82; and 121, 121), said lifting blades (41, 41) being reciprocal between a lower shed position and an upper shed position, said pulling elements (42, 42) being interconnected in pairs by kinematic connecting means including a kinematic connecting element (1) entrained about a pulling block (2) and connected to a strand (7), said lifting blades (41, 61) and pulling elements (42, 62) having first cooperative means (51, 48; 66, 67) for engaging each other in cooperation with retention device means (12) having at least one electromagnetic means (13,14) constructed and arranged such that in an area of a lower shed position said electromagnetic means can be energized or de-energized in accordance with a pattern program to selectively engage or disengage said first cooperative means whereby said pulling elements can be moved into the upper shed position or left in the lower shed position, said lifting blades and pulling elements further including second cooperative means (41, 54; 61, 65) for engaging each other to move an associated pulling element and lifting blade into the lower shed position, said pulling elements and lifting blades being adapted to be movable along a predetermined substantially linear path of movement, said second cooperative means (41, 54; 61, 65) including mutual abutment faces disposed substantially normal to said predetermined substantially linear path of movement which creates a vertical pushing force of the lifting blades relative to associated pulling elements thereby effecting substantially exclusive linear movement along said predetermined path, each pulling element being in the form of an elongated member having a guiding portion (53, 64), means (45) in the form of a fixed mounting board (44, 46) associated with each pulling element guiding portion for guiding each pulling element during the movement thereof tinder the control of said retention device means (12), said retention device means (12) being of a wedge-shaped configuration, said at least one electromagnetic means (13, 14) defining magnetic areas (23; 24; 38; 39) which are formed in association with cooperative pairs of inclined surfaces with each inclined surface associated with one of said pulling elements, said retention device means (12) each including a base edge, a predetermined air gap (A) being defined between each base edge and an associated pulling element, and said magnetic pole areas (23; 24; 38; 39) being located at a distance from each other and parallel relative to the path of movement of the pulling elements.

15. The shedding device as defined in claim 14 wherein said at least one electromagnetic means defines a magnetic flux path which acts directly upon each associated pulling element.

16. The shedding device as defined in claim 14 wherein each of said pulling elements is constructed of plastic material.

17. The shedding device as defined in claim 14 wherein each of said pulling elements is constructed of metallic material.

18. The shedding device as defined in claim 14 wherein each of said pulling elements is constructed of relatively resilient plastic material.

19. The shedding device as defined in claim 14 wherein each of said pulling elements is constructed of relatively resilient metallic material.

20. The shedding device as defined in claim 14 wherein the guiding portions of cooperative pairs of pulling elements are connected to said kinematic connecting element, and each pulling element further includes an upper end portion (52, 63, etc.) carrying said first cooperative means.

21. The shedding device as defined in claim 14 wherein each pulling element of a cooperative pair of pulling elements has an upper end portion carrying said first cooperative means, and each pulling element of each cooperative pair of pulling elements includes a medial portion between the associated upper end portion and guiding portion thereof carrying said second cooperative means.

22. A shedding device for a textile machine comprising two oppositely movable lifting blades (41, 41; 61, 61; 68, 68; 81, 81; and 120, 120) each associated with a pair of pulling elements (42, 42; 62, 62; 82, 82; and 121, 121), said lifting blades (41, 41) being reciprocal between a lower shed position and an tipper shed position, said pulling elements (42, 42) being interconnected in pairs by kinematic connecting means including a kinematic connecting element (1) entrained about a pulling block (2) and connected to a strand (7), said lifting blades (41, 61) and pulling elements (42, 62) having first cooperative means (51, 48; 66, 67) for engaging each other in cooperation with retention device means (12) having at least one electromagnetic means (13,14) constructed and arranged such that in an area of a lower shed position said electromagnetic means can be energized or de-energized in accordance with a pattern program to selectively engage or disengage said first cooperative means whereby said pulling elements can be moved into the upper shed position or left in the lower shed position, said lifting blades and pulling elements further including second cooperative means (41, 54; 61, 65) for engaging each other to move an associated pulling element and lifting blade into the lower shed position, said pulling elements and lifting blades being adapted to be movable along a predetermined substantially linear path of movement, said second cooperative means (41, 54; 61, 65) including mutual abutment faces disposed substantially normal to said predetermined substantially linear path of movement which creates a vertical pushing force of the lifting blades relative to associated pulling elements thereby effecting substantially exclusive linear movement along said predetermined path, each pulling element being in the form of an elongated member having a guiding portion (53, 64), means (45) in the form of a fixed mounting board (44, 46) associated with each pulling element guiding portion for guiding each pulling element during the movement thereof tinder the control of said retention device means (12), said retention device means (12) being of a wedge-shaped configuration, said at least one electromagnetic means (13,14) defining magnetic areas (23; 24; 38; 39) which are formed in association with cooperative pairs of inclined surfaces with each inclined surface associated with one of said pulling elements, said retention device means (12) each including a base edge, a predetermined air gap (A) being defined between each base edge and an associated pulling element, and said magnetic pole areas (23; 24; 38; 39) being arranged at a distance form each other and laterally relative to the path of movement of the pulling elements.

23. The shedding device as defined in claim 22 wherein said at least one electromagnetic means defines a magnetic flux path which acts directly upon each associated pulling element.

24. The shedding device as defined in claim 22 wherein each of said pulling elements is constructed of plastic material.

25. The shedding device as defined in claim 22 wherein each of said pulling elements is constructed of metallic material.

26. The shedding device as defined in claim 22 wherein each of said pulling elements is constructed of relatively resilient plastic material.

27. The shedding device as defined in claim 22 wherein each of said pulling elements is constructed of relatively resilient metallic material.

28. The shedding device as defined in claim 22 wherein the guiding portions of cooperative pairs of pulling elements are connected to said kinematic connecting element, and each pulling element further includes an upper end portion (52, 63, etc.) carrying said first cooperative means.

29. The shedding device as defined in claim 22 wherein each pulling element of a cooperative pair of pulling elements has an upper end portion carrying said first cooperative means, and each pulling element of each cooperative pair of pulling elements includes a medial portion between the associated upper end portion and guiding portion thereof carrying said second cooperative means.

30. A shedding device for a textile machine comprising two oppositely movable lifting blades (41, 41; 61, 61; 68, 68; 81, 81; and 120, 120) each associated with a pair of pulling elements (42, 42; 62, 62; 82, 82; and 121, 121), said lifting blades (41, 41) being reciprocal between a lower shed position and an upper shed position, said pulling elements (42, 42) being interconnected in pairs by kinematic connecting means including a kinematic connecting element (1) entrained about a pulling block (2) and connected to a strand (7), said lifting blades (41, 61) and pulling elements (42, 62) having first cooperative means (51, 48; 66, 67) for engaging each other in cooperation with retention device means (12) having at least one electromagnetic means (13, 14) constructed and arranged such that in an area of a lower shed position said electromagnetic means can be energized or de-energized in accordance with a pattern program to selectively engage or disengage said first cooperative means whereby said pulling elements can be moved into the tipper shed position or left in the lower shed position, said lifting blades and pulling elements further including second cooperative means (41, 54; 61, 65) for engaging each other to move an associated pulling element and lifting blade into the lower shed position, said pulling elements and lifting blades being adapted to be movable along a predetermined substantially linear path of movement, said second cooperative means (41, 54; 61, 65) including mutual abutment faces disposed substantially normal to said predetermined substantially linear path of movement which creates a vertical pushing force of the lifting blades relative to associated pulling elements thereby effecting substantially exclusive linear movement along said predetermined path, each pulling element being in the form of an elongated member having a guiding portion (53, 64), means (45) in the form of a fixed mounting board (44, 46) associated with each pulling element guiding portion for guiding each pulling element during the movement thereof tinder the control of said retention device means (12), each pulling element of a cooperative pair of pulling elements having an tipper end portion carrying said first cooperative means, each pulling element of each cooperative pair of pulling elements including a medial portion between the associated upper end portion and guiding portion thereof carrying said second cooperative means, and at least one of said first and second cooperative means being an opening.

31. A shedding device for a textile machine comprising two oppositely movable lifting blades (41, 41; 61, 61; 68, 68; 81, 81; and 120, 120) each associated with a pair of pulling elements (42, 42; 62, 62; 82, 82; and 121, 121), said lifting blades (41, 41) being reciprocal between a lower shed position and an upper shed position, said pulling elements (42, 42) being interconnected in pairs by kinematic connecting means including a kinematic connecting element (1) entrained about a pulling block (2) and connected to a strand (7), said lifting blades (41, 61) and pulling elements (42, 62) having first cooperative means (51, 48; 66, 67) for engaging each other in cooperation with retention device means (12) having at least one electromagnetic means (13,14) constructed and arranged such that in an area of a lower shed position said electromagnetic means can be energized or de-energized in accordance with a pattern program to selectively engage or disengage said first cooperative means whereby said pulling elements can be moved into the tipper shed position or left in the lower shed position, said lifting blades and pulling elements further including second cooperative means (41, 54; 61, 65) for engaging each other to move an associated pulling element and lifting blade into the lower shed position, said pulling elements and lifting blades being adapted to be movable along a predetermined substantially linear path of movement, said second cooperative means (41, 54; 61, 65) including mutual abutment faces disposed substantially normal to said predetermined substantially linear path of movement which creates a vertical pushing force of the lifting blades relative to associated pulling elements thereby effecting substantially exclusive linear movement along said predetermined path, each pulling element being in the form of an elongated member having a guiding portion (53, 64), means (45) in the form of a fixed mounting board (44, 46) associated with each pulling element guiding portion for guiding each pulling element during the movement thereof under the control of said retention device means (12), and one of said first and second cooperative means being a projection and the other of said first and second cooperative means being an opening.

32. The shedding device as defined in claim 31 wherein said projection and opening are complementary contoured.

33. A shedding device for a textile machine comprising two oppositely movable lifting blades (41, 41; 61, 61; 68, 68; 81, 81; and 120, 120) each associated with a pair of pulling elements (42, 42; 62, 62; 82, 82; and 121, 121), said lifting blades (41, 41) being reciprocal between a lower shed position and an upper shed position, said pulling elements (42, 42) being interconnected in pairs by kinematic connecting means including a kinematic connecting element (1) entrained about a pulling block (2) and connected to a strand (7), said lifting blades (41, 61) and pulling elements (42, 62) having first cooperative means (51, 48; 66, 67) for engaging each other in cooperation with retention device means (12) having at least one electromagnetic means (13,14) constructed and arranged such that in an area of a lower shed position said electromagnetic means can be energized or de-energized in accordance with a pattern program to selectively engage or disengage said first cooperative means whereby said pulling elements can be moved into the upper shed position or left in the lower shed position, said lifting blades and pulling elements further including second cooperative means (41, 54; 61, 65) for engaging each other to move an associated pulling element and lifting blade into the lower shed position, said pulling elements and lifting blades being adapted to be movable along a predetermined substantially linear path of movement, said second cooperative means (41, 54; 61, 65) including mutual abutment faces disposed substantially normal to said predetermined substantially linear path of movement which creates a vertical pushing force of the lifting blades relative to associated pulling elements thereby effecting substantially exclusive linear movement along said predetermined path, each pulling element being in the form of an elongated member having a guiding portion (53, 64), means (45) in the form of a fixed mounting board (44, 46) associated with each pulling element guiding portion for guiding each pulling element during the movement thereof under the control of said retention device means (12), and wherein said first and second cooperative means being hooks.

34. A shedding device for a textile machine comprising two oppositely movable lifting blades (41, 41; 61, 61; 68, 68; 81, 81; and 120, 120) each associated with a pair of pulling elements (42, 42; 62, 62; 82, 82; and 121, 121), said lifting blades (41, 41) being reciprocal between a lower shed position and an upper shed position, said pulling elements (42, 42) being interconnected in pairs by kinematic connecting means including a kinematic connecting element (1) entrained about a pulling block (2) and connected to a strand (7), said lifting blades (41, 61) and pulling elements (42, 62) having first cooperative means (51, 48; 66, 67) for engaging each other in cooperation with retention device means (12) having at least one electromagnetic means (13,14) constructed and arranged such that in an area of a lower shed position said electromagnetic means can be energized or de-energized in accordance with a pattern program to selectively engage or disengage said first cooperative means whereby said pulling elements can be moved into the upper shed position or left in the lower shed position, said lifting blades and pulling elements further including second cooperative means (41, 54; 61, 65) for engaging each other to move an associated pulling element and lifting blade into the lower shed position, said pulling elements and lifting blades being adapted to be movable along a predetermined substantially linear path of movement, said second cooperative means (41, 54; 61, 65) including mutual abutment faces disposed substantially normal to said predetermined substantially linear path of movement which creates a vertical pushing force of the lifting blades relative to associated pulling elements thereby effecting substantially exclusive linear movement along said predetermined path, each pulling element being in the form of an elongated member having a guiding portion (53, 64), means (45) in the form of a fixed mounting board (44, 46) associated with each pulling element guiding portion for guiding each pulling element during the movement thereof under the control of said retention device means (12), first and second cooperative means being hooks, and said hooks being complementary contoured.

* * * * *